United States Patent [19]

Kazui

[11] Patent Number: 4,706,563

[45] Date of Patent: Nov. 17, 1987

[54] CARD PRINTER BY MEANS OF A CARD FEEDING AND TYPE SELECTING PRINTING METHOD

[76] Inventor: Takahide Kazui, No. 2543, Imajuku-cho, Asahi-ku, Yokohama-shi, Kanagawa-ken, Japan

[21] Appl. No.: 924,182

[22] Filed: Oct. 23, 1986

Related U.S. Application Data

[63] Continuation of Ser. No. 770,072, Aug. 28, 1985, abandoned.

[30] Foreign Application Priority Data

Mar. 2, 1984 [JP] Japan ..... 59-40068

[51] Int. Cl.[4] ..... B41J 1/08

[52] U.S. Cl. ..... 101/93.43; 101/93.47; 400/147

[58] Field of Search ..... 101/93.37, 93.38, 93.39, 101/93.40, 93.01, 93.43, 93.46, 93.47, 93.48; 400/147, 191, 211, 127.1, 129, 131–132, 134.6, 23, 36, 48, 103–104

[56] References Cited

U.S. PATENT DOCUMENTS

| | | | |
|---|---|---|---|
| 2,890,651 | 6/1959 | Hosken | 101/93.47 X |
| 3,312,163 | 4/1967 | Muyshondt | 101/93.47 |
| 3,410,204 | 11/1968 | Burkhard | 101/93.47 |
| 3,449,639 | 6/1969 | Brown et al. | 101/93.48 X |
| 3,712,210 | 1/1973 | Landis | 101/93.43 |
| 3,713,138 | 1/1973 | Girard | 101/93.47 X |
| 3,942,436 | 3/1976 | Lupkas | 101/93.43 |
| 3,977,509 | 8/1976 | Leersnijder | 400/147 |
| 4,242,658 | 12/1980 | Helinski | 101/93.48 |

FOREIGN PATENT DOCUMENTS

| | | | |
|---|---|---|---|
| 146248 | 6/1985 | European Pat. Off. | 400/105 |
| 31584 | 2/1982 | Japan | 400/147 |
| 838636 | 6/1960 | United Kingdom | 101/93.47 |

*Primary Examiner*—E. H. Eickholt

*Attorney, Agent, or Firm*—Oblon, Fisher, Spivak, McClelland & Maier

[57] ABSTRACT

A card printer comprises a type group consisting of a number of types being worked in a desired printing pitch. The types are in a lined-up arrangement in a horizontal direction and are received in a type receiving case so as to carry out an impact printing at their front. A correspondingly solenoid and a corresponding armature group electromagnetically drives each type in response to a control system. A feed system controlled by a control system feed successive cards and a ribbon in a horizontal direction facing the type group. At every place feed of the card by the feed system, a position on the card for a letter or a code to be printed and a lined-up position of a corresponding type are electronically checked and selected by a control system, and, only when the two card and type positions agree each other, a type or types in or are successively or at the same time driven electromagnetically by the corresponding solenoid and the corresponding armature so as to automatically print on the card.

4 Claims, 3 Drawing Figures

CARD PRINTER BY MEANS OF A CARD FEEDING AND TYPE SELECTING PRINTING METHOD

This application is a continuation of application Ser. No. 770,072, filed on Aug. 28, 1985, now abandoned.

FIELD OF THE INVENTION

The present invention relates to a card printer by means of a card feeding and type selecting printing method.

BACKGROUND OF THE INVENTION

When MICR (magnetic ink letter) and OCR letters are printed on bills, checks, bonds, card forms, etc. used in banking facilities, etc., designated letters have been conventionally in many cases selected by means of revolving a type wheel (type element) with a pulse motor, etc. and printed by means of an electromagnetic revolution with a driving wheel and a solenoid. However, in those cases, drawbacks such as the following are found: it takes time to fix a determined type position by means of a revolving type wheel and a type valve; the construction is complicated and results in 50 CPS of printing speed at the most; the construction produces a high driving sound; and the construction is expensive.

SUMMARY OF THE INVENTION

In order to overcome the conventional drawbacks, the present invention is directed to providing a type group of which each type is worked in a desired printing pitch and lined-up and received in a horizontal direction so as to carry out an impact printing at its front, a solenoid and an armature group electromagnetically revolves those individual types by a control system, a feed system consists of a control system of feeding a card and a ribbon situated on the opposite side of the type group in a horizontal direction. At every place of a type or one pitch feed by the feed system, a location on a card to be printed with a letter or a code and a corresponding type lined-up position are checked and selected by a control system. Only when the card and type positions agree with each other, a type or types is or are electromagnetically driven successively or one at a time by the solenoid and the armature to automatically print on the card. Thus, the repeated actions make the card pass by an opposite type group completely so as to finish a desired printing. Namely, the present invention is directed to a card printer by means of a card feeding and card selecting printing method.

The present invention is different from the conventional type moving method and adopts a type position fixing method in which the letter selecting time is an electronic speed, and only the card feeding time and the electromagnetic driving time of the armature hammers effect the printing time. Therefore, the present invention is a card printer which is capable of a high speed printing. Moreover, the present invention is inexpensive because of its simple construction and is easy to manufacture.

The details and advatages of the invention will be apparent from the following description of an embodiment taken in conjunction with the accompanying drawings.

BRIEF DESCRIPTION OF THE DRAWINGS

The drawings show an example of a card printer according to the invention.

FIG. 2 is a side view of the card printer; and (I), (II), and (III) of

DETAILED DESCRIPTION OF THE PRESENTLY PREFERRED EMBODIMENT

[EXAMPLE]

Figure 1:
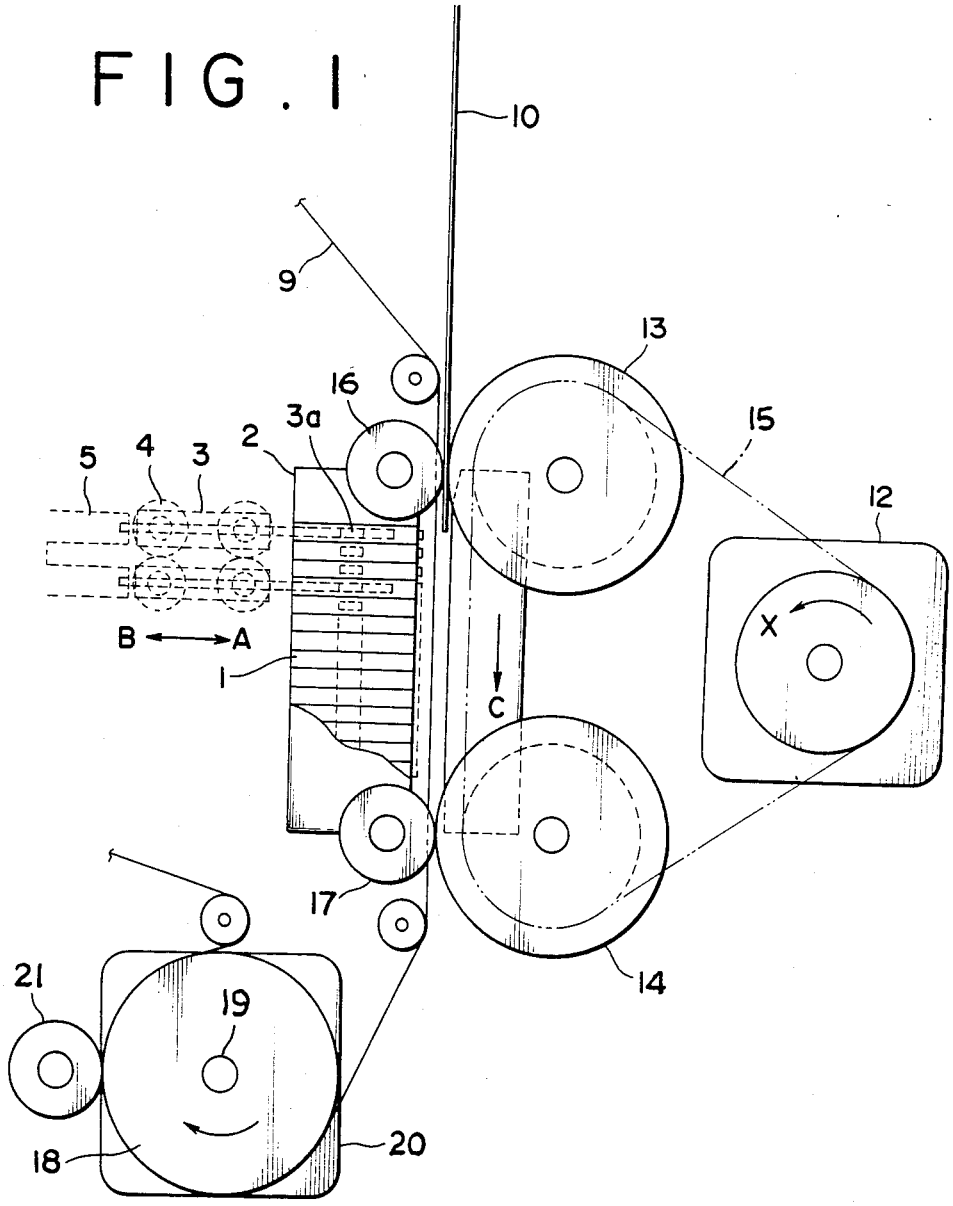
FIG. 1 is a plan view.
Figure 2:
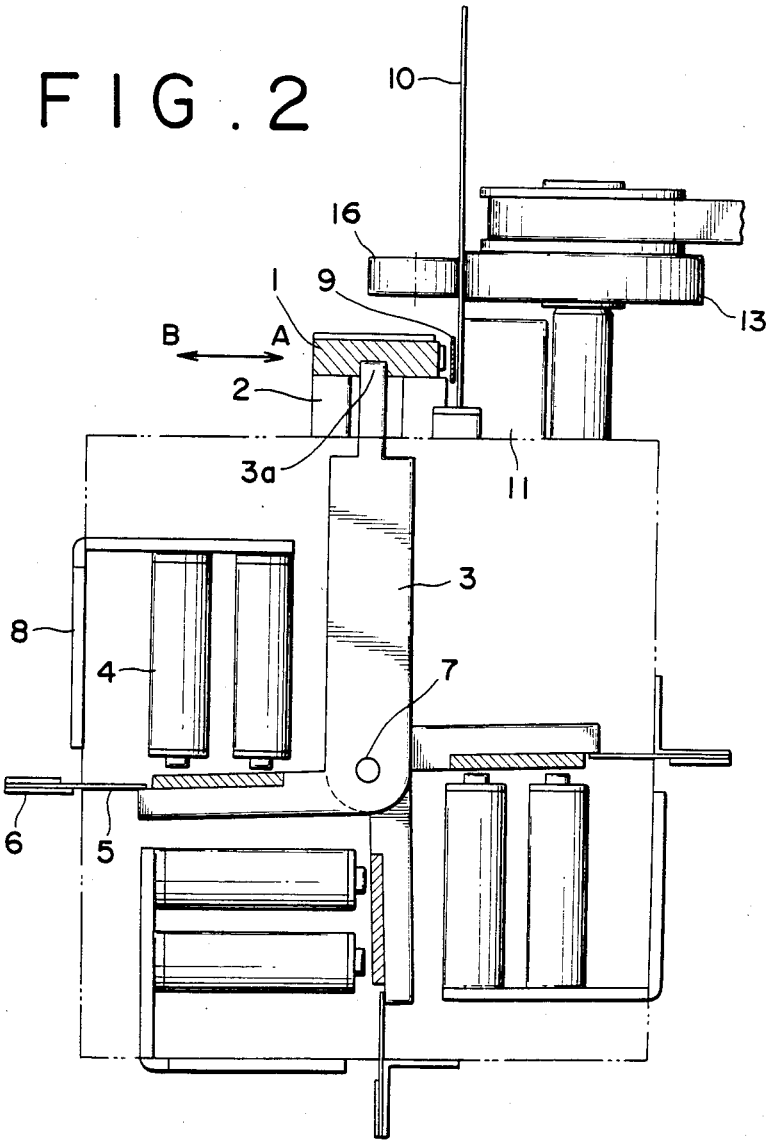

As shown in FIGS. 1 and 2, each type 1 is the same as a printing pitch in width. The types 1 are lined-up and received in a type receiving case 2 so as to be slidable in a printing direction A—B. Each type 1 is connected an end 3*a* of a corresponding respective driving armature 3 and driven in the A direction for printing in response to a signal of a control system (not shown) by means of a corresponding respective solenoid 4 set up radially.

Further, numeral 5 represents an armature spring, numeral 6 represents an armature spring fixing plate, numeral 7 represents an armature pivot, numeral 8 represents a solenoid angle, numeral 9 represents a ribbon, numeral 10 represents a card, and numeral 11 represents a platen. The card 10 is fed in a C direction past the types 1 by an X directional rotation of a pulse motor 12, by two capstan rollers 13 and 14 interlocked with the pulse motor 12 by a timing belt 15, and by corresponding respective pinch rollers 16 and 17. The ribbon 9 is supplied in the C direction (i.e., in the same direction as the card feed) by a capstan roller 18 fixed to a shaft 19 driven by a pulse motor 20 and a pinch roller 21. When the ribbon 9 is an one-time use type, the capstan rollers 13, 14 and 18 are designed with the same diameter so as to supply the ribbon 9 in a pitch that is the same as that of the card. Further, the pulse motors 12 and 20 in the feed systems are individually operated according to the signals of the respective control systems.

Figure 3:
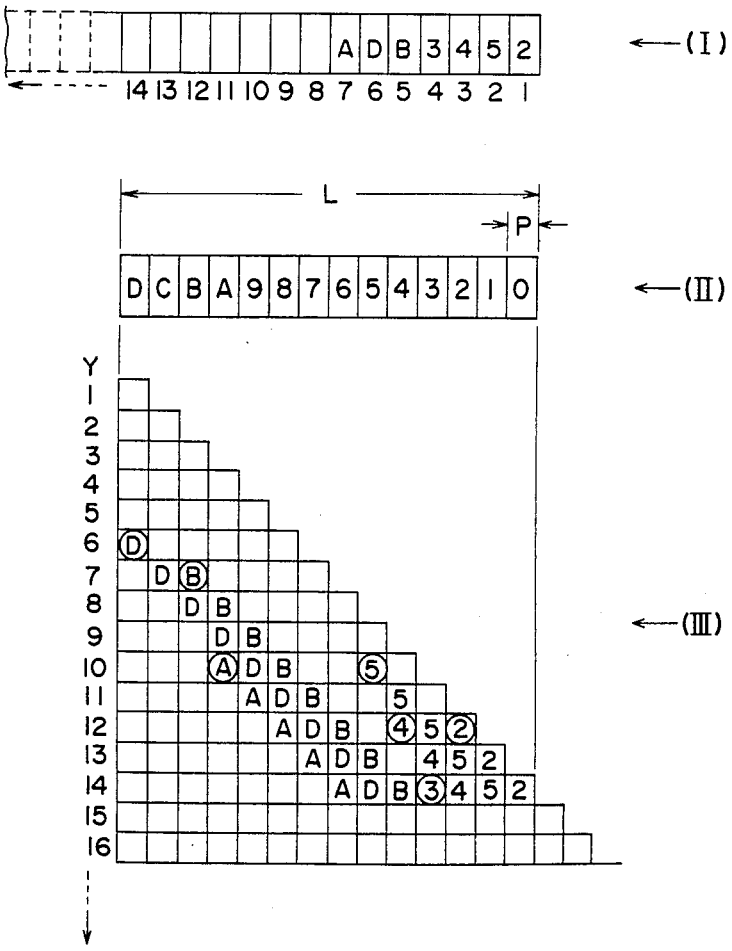
FIG. 3 are illustrations used in explaining the printing action.

Turning to FIG. 3, printing actions by means of the card feeding and type selecting method of the invention will be explained. (I) indicates letters to be printed and represents data of ADB 3452 being supposed to be printed. (II) indicates a lining-up arrangement of the type 1 in which (P) is a printing pitch and (L) is a lining-up length consisted of letters for fourteen kinds of 0–9 ABCD and lined-up with types to make up a (P)×14 length. (III) indicates the coordinates of a card feed and a printing process with Y representing the printing process and the data surrounded by circles representing positions to be printed.

Firstly, the letters of (I) to be printed are input by a suitable means or a computer control system, for example, and then the card 10 is fed in the C direction facing the type lining-up arrangement of (II) by the feed system. At this moment or at every one pitch feed of the card 10, a position on the card for a letter shown in (I) and a lining-up position for a type in (II) are checked and selected electronically by the control system. As shown in (III), the type D at 6th pitch first selected by the selecting action is driven for printing in the A direction by the corresponding solenoid 4 and the corresponding armature 3, which are driven electromagnetically due to a synchronization with the selection, and thus are printed on the card 10. Succeedingly, as the feed of the card 10 advances, the printing is carried out automatically in the order of B, A, 5, 4, 2 and 3 as shown in (III), and the card 10 eventually passes by the line-up arrangement of the type group in (II) after completing a desired printing. During the above operation, the pulse motors 12 and 20 of the feed system are managed by a control system to operate respectively and automatically in response to the selecting action of each type 1.

What is claimed is:

1. A printer comprising:

(a) a platen;

(b) a type receiving case containing a plurality of types in a linear array, each one of said plurality of types being independent movable towards said platen in a printing direction, said plurality of types being spaced from one another by a uniform distance corresponding to the pitch of the symbols to be printed;

(c) first means for independently driving each one of said plurality of types in the printing direction, said first means comprising:

(i) a plurality of driving armatures, each one of said plurality of driving armatures being operatively connected to a corresponding one of said plurality of types;

(ii) a plurality of solenoids, each one of said plurality of solenoids being operatively connected to a corresponding one of said plurality of driving armatures; and (iii) a plurality of armature springs, each one of said plurality of armature springs being operatively connected to a corresponding one of said plurality of driving armatures;

(d) second means for incrementally feeding a printing medium between said platen and said type receiving case in stepwise fashion in a direction perpendicular to the printing direction of said plurality of types, said second means feeding the printing medium one pitch distance, then stopping the printing medium, then feeding the printing medium by another pitch distance, and so on, said second means comprising:

(i) a first pulse motor;

(ii) a first capstan roller mounted upstream of said type receiving case;

(iii) a second capstan roller mounted downstream of said type receiving case;

(iv) a timing belt driven by said first pulse motor and operatively connected to said first and second capstan rollers;

(v) a first pinch roller sized, shaped, and positioned to cooperate with said first capstan roller to drivingly engage the printing medium; and (vi) a second pinch roller sized, shaped, and positioned to cooperate with said second capstan roller to drivingly engage the printing medium; and (e) third means for incrementally feeding a print ribbon in stepwise fashion between said plurality of types and a printing medium fed by said second means, said third means feeding the print ribbon by the same pitch distance, then stopping the print ribbon, then feeding the print ribbon by another pitch distance, and so on, said third means comprising:

(i) a second pulse motor operated independently of said first pulse motor;

(ii) a third capstan roller operatively connected to said second pulse motor; and (iii) a third pinch roller sized, shaped, and positioned to cooperate with said third capstan roller to drivingly engage the print ribbon, whereby each one of said plurality of types can be independently driven in the printing direction as a printing medium and a print ribbon are stationary in front of said type receiving case, thereby forcing the printing medium against said platen and printing a desired sequence of symbols on the printing medium.

2. A printer as recited in claim 1 wherein said second means comprise a pulse motor adapted to move the printing medium by one pitch during each pulse, whereby a fresh space on the printing medium on which a symbol may be printed is presented in front of each one of said plurality of types after each movement of the printing medium effected by said pulse motor.

3. A printer as recited in claim 2 wherein said second means comprises means for feeding cards past said type receiving case.

4. A printer as recited in claim 1 wherein:

(a) each one of said plurality of armatures is mounted for pivotal movement about a corresponding one of a plurality of armature pivots;

(b) actuation of each one of said plurality of solenoids causes the corresponding one of said plurality of armatures to move away from said platen; and (c) each one of said plurality of armature springs biases the corresponding one of said plurality of armatures towards said platen.

* * * * *